US008111123B2

(12) United States Patent
Lim et al.

(10) Patent No.: US 8,111,123 B2
(45) Date of Patent: Feb. 7, 2012

(54) DISC WOUND TRANSFORMER WITH IMPROVED COOLING

(75) Inventors: Jong-Yun Lim, Chonan-Si (KR); Chang-Yeol Lim, Chonan-Si (KR); Young-Jin Ha, Cheonan (KR); Chang-Hyeon Lee, Chonan-Si (KR); Charles W. Johnson, Wytheville, VA (US); Hae-Sun Yang, Chonan-Si (KR); Rafael Murillo, Aragòn (ES); Robert C. Ballard, Wytheville, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/879,601

(22) Filed: Sep. 10, 2010

(65) Prior Publication Data

US 2011/0063062 A1 Mar. 17, 2011

Related U.S. Application Data

(60) Provisional application No. 61/241,684, filed on Sep. 11, 2009.

(51) Int. Cl.
*H01F 27/08* (2006.01)

(52) U.S. Cl. ..... 336/55

(58) Field of Classification Search ..... 336/180–186, 336/223, 55–62, 90–96; 29/605–606, 602.1
See application file for complete search history.

(56) References Cited

U.S. PATENT DOCUMENTS

| | | | | |
|---|---|---|---|---|
| 3,201,728 | A | 8/1965 | McWhirter | |
| 3,431,524 | A | 3/1969 | Broverman | |
| 3,548,355 | A | 12/1970 | Martincic et al. | |
| 4,000,482 | A * | 12/1976 | Staub et al. | 336/60 |
| 4,129,845 | A | 12/1978 | Benke | |
| 4,219,791 | A | 8/1980 | Moore et al. | |
| 4,523,169 | A | 6/1985 | Hay | |
| 4,540,536 | A | 9/1985 | Altmann et al. | |
| 5,167,063 | A | 12/1992 | Hulsink | |
| 5,588,201 | A | 12/1996 | Alber et al. | |
| 6,221,297 | B1 | 4/2001 | Lanoue et al. | |
| 6,223,421 | B1 | 5/2001 | Lanoue et al. | |
| 6,368,530 | B1 | 4/2002 | Adubato et al. | |
| 6,806,803 | B2 | 10/2004 | Hopkinson et al. | |
| 6,930,579 | B2 | 8/2005 | Radford et al. | |
| 7,023,312 | B1 | 4/2006 | Lanoue et al. | |
| 7,647,692 | B2 | 1/2010 | Lanoue et al. | |
| 7,688,170 | B2 | 3/2010 | Pauley, Jr. et al. | |
| 7,719,397 | B2 | 5/2010 | Pauley, Jr. et al. | |
| 7,886,424 | B2 | 2/2011 | Pauley, Jr. et al. | |

FOREIGN PATENT DOCUMENTS

| | | |
|---|---|---|
| WO | WO0039819 | 7/2000 |
| WO | W02011029488 | 3/2011 |
| WO | W02011031960 | 3/2011 |

* cited by examiner

*Primary Examiner* — Tuyen Nguyen
(74) *Attorney, Agent, or Firm* — Paul R. Katterle

(57) ABSTRACT

A method of manufacturing a transformer that includes forming a disc-wound coil using a plurality of pre-formed cooling ducts. Each cooling duct may be supported by a support pipe secured between walls of the cooling duct, or by a removable insert. First and second conductor layers are formed, each of which include plurality of disc windings arranged in an axial direction of the disc-wound coil. A spacer layer is formed between the first and second conductor layers to form a plurality of axially-extending passages. The cooling ducts are slid into the axially-extending passages so as to be disposed between the first and second conductor layers.

20 Claims, 11 Drawing Sheets

DISC WOUND TRANSFORMER WITH IMPROVED COOLING

CROSS-REFERENCE TO RELATED APPLICATION

This application claims the benefit of U.S. provisional patent application No. 61/241,684 filed on Sep. 11, 2009, which is hereby incorporated by reference in its entirety.

BACKGROUND OF THE INVENTION

This invention relates to transformers and more particularly to transformers with a disc wound coil.

As is well known, a transformer converts electricity at one voltage to electricity as another voltage, either of higher or lower value. A transformer achieves this voltage conversion using a primary coil and a secondary coil, each of which is wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load. Two main winding techniques are used to form coils, namely layer winding and disc winding. The type of winding technique that is utilized to form a coil is primarily determined by the number of turns in the coil and the current in the coil. For high voltage windings with a large number of required turns, the disc winding technique is typically used, whereas for low voltage windings with a smaller number of required turns, the layer winding technique is typically used.

In the disc winding technique, the conductor turns required for a coil are wound in a plurality of discs serially disposed along the axial length of the coil. In each disc, the turns are wound in a radial direction, one on top of the other, i.e., one turn per layer. The discs are connected in a series circuit relation and are typically wound alternately from inside to outside and from outside to inside so that the discs can be formed from the same conductor. An example of such alternate winding is shown in U.S. Pat. No. 5,167,063.

A transformer with disc windings may be dry, i.e., cooled by air as opposed to a liquid dielectric. In such a dry transformer, the disc windings may be coated with, or cast in, a dielectric resin using vacuum chambers, gelling ovens etc. If the disc windings are cast in a solid dielectric resin, cooling issues are raised. In order to address these issues, U.S. patent application Ser. No. 11/494,087 to Pauley et al. (which is assigned to the assignee of this application and is hereby incorporated by reference) discloses using pre-formed cooling ducts to provide cooling. The present invention is directed toward improvements in the construction, installation and use of such pre-formed cooling ducts in a cast resin transformer having disc windings.

SUMMARY OF THE INVENTION

The present invention is directed to a method of manufacturing a transformer. In accordance with the method, a disc-wound coil is formed using a plurality of pre-formed cooling ducts. A first conductor layer is formed that includes a plurality of disc windings arranged in an axial direction of the disc-wound coil. Each of the disc windings includes a conductor wound into a plurality of concentric turns. A spacer layer is formed over the first conductor layer. The spacer layer includes a plurality of spacers. A second conductor layer is formed over the spacer layer. The second conductor layer includes a plurality of disc windings arranged in an axial direction of the disc-wound coil. Each of the disc windings includes a conductor wound into a plurality of concentric turns. The spacer layer is formed such that when the second conductor layer is formed, a plurality of axially-extending passages is formed between the first and second conductor layers. The pre-formed cooling ducts are slid into the axially-extending passages so as to be disposed between the first and second conductor layers.

Also provided in accordance with the present invention is a transformer that includes a disc-wound coil having a first conductor layer that includes a plurality of disc windings arranged in an axial direction of the disc-wound coil. Each of the disc windings includes a conductor wound into a plurality of concentric turns. A second conductor layer is disposed over the first conductor layer. The second conductor layer includes a plurality of disc windings arranged in an axial direction of the disc-wound coil. Each of the disc windings includes a conductor wound into a plurality of concentric turns. A spacer layer is disposed between the first and second conductor layers. The spacer layer includes a plurality of spacers arranged so as to form a plurality of axially-extending passages between the first and second conductor layers. A plurality of cooling ducts is disposed inside the axially-extending passages, respectively, thereby being positioned between the first and second conductor layers.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
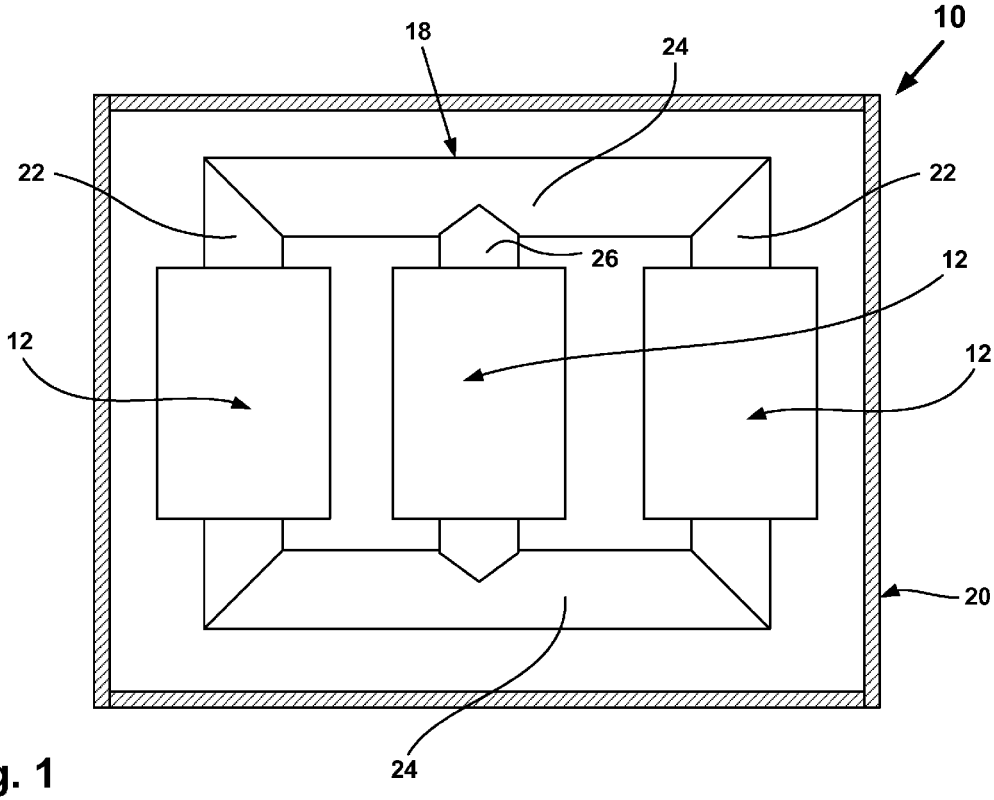
FIG. 1 is a schematic sectional view of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown an interior view of a three phase transformer 10 containing a coil embodied in accordance with the present invention. The transformer 10 comprises three coil assemblies 12 (one for each phase) mounted to a core 18 and enclosed within a ventilated outer housing 20. The core 18 is comprised of ferromagnetic metal and is generally rectangular in shape. The core 18 includes a pair of outer legs 22 extending between a pair of yokes 24. An inner leg 26 also extends between the yokes 24 and is disposed between and is substantially evenly spaced from the outer legs 22. The coil assemblies 12 are mounted to and disposed around the outer legs 22 and the inner leg 26, respectively. Each coil assembly 12 comprises a high voltage coil 30 and a low voltage coil, each of which is cylindrical in shape. If the transformer 10 is a step-down transformer, the high voltage coil 30 is the primary coil and the low voltage coil is the secondary coil. Alternately, if the transformer 10 is a step-up transformer, the high voltage coil 30 is the secondary coil and the low voltage coil is the high voltage coil. In each coil assembly 12, the high voltage coil 30 and the low voltage coil may be mounted concentrically, with the low voltage coil being disposed within and radially inward from the high voltage coil 30, as shown in FIG. 1. Alternately, the high voltage coil 30 and the low voltage coil may be mounted so as to be axially separated, with the low voltage coil being mounted above or below the high voltage coil 30.

The transformer 10 is a distribution transformer and may have a kVA rating in a range of from about 112.5 kVA to about 15,000 kVA. The voltage of the high voltage coil may be in a range of from about 600 V to about 35 kV and the voltage of the low voltage coil may be in a range of from about 120 V to about 15 kV.

Although the transformer 10 is shown and described as being a three phase distribution transformer, it should be appreciated that the present invention is not limited to three phase transformers or distribution transformers. The present invention may utilized in single phase transformers and transformers other than distribution transformers.

Figure 2:
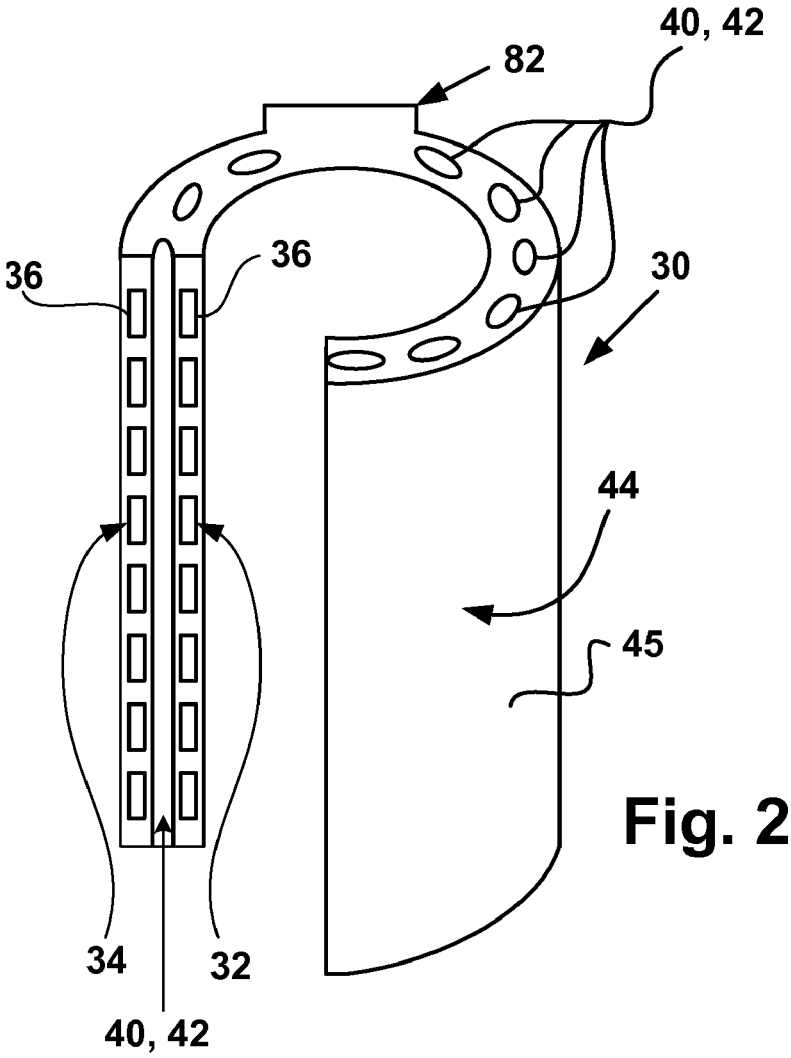
FIG. 2 shows a perspective view of a coil of the transformer, with a portion of the coil cut away to show a cross-section of a portion of the coil.
Figure 3:
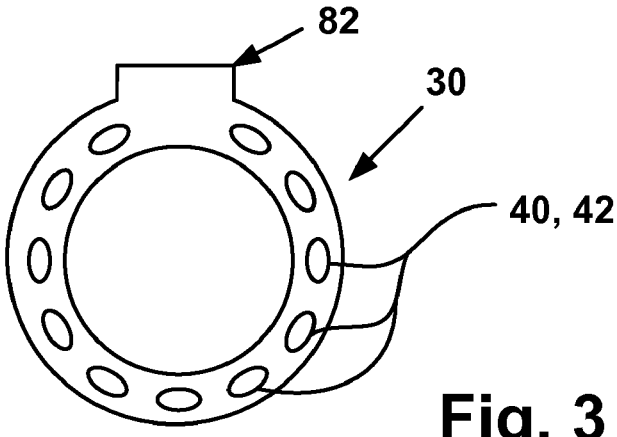
FIG. 3 shows an end view of the coil.
Figure 4:
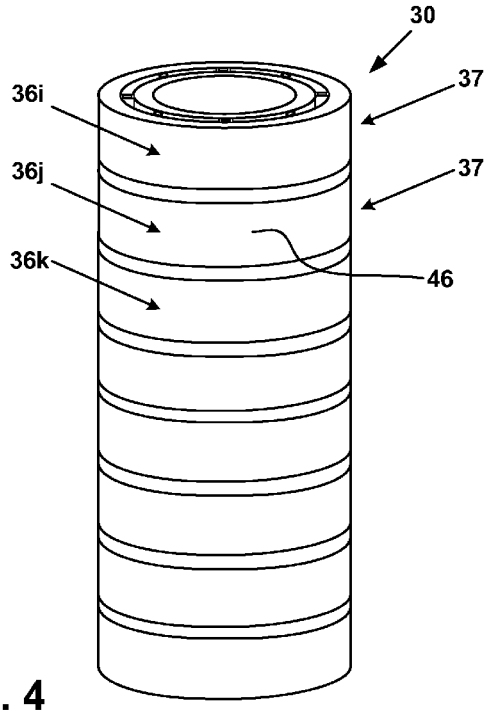
FIG. 4 shows a plurality of coaxial pairs of disc windings of the coil.

FIGS. 2-3 show one of the high voltage coils 30, which are constructed in accordance with the present invention. Each high voltage coil 30 has a plurality of conductor layers, which comprise at least an inner or first conductor layer 32 and an outer or second conductor layer 34. Each of the first and second conductor layers 32, 34 comprises a plurality of disc windings 36. The disc windings 36 in the first conductor layer 32 may be coaxially disposed inside the disc windings 36 in the second conductor layer 34, respectively, so as to form coaxial pairs 37 of disc windings 36 that are arranged along a longitudinal axis of the high voltage coil 30, as shown in FIG. 4. A plurality of pre-formed cooling ducts 40 or 42 are disposed around the circumference of the high voltage coil 30 in a spaced-apart manner. The cooling ducts 40, 42 are positioned between the first and second conductor layers 32, 34. The cooling ducts 40, 42 and the first and second conductor layers 32, 34 are encapsulated in an encasement 44 comprised of a solid dielectric insulating resin 45.

Figure 7:
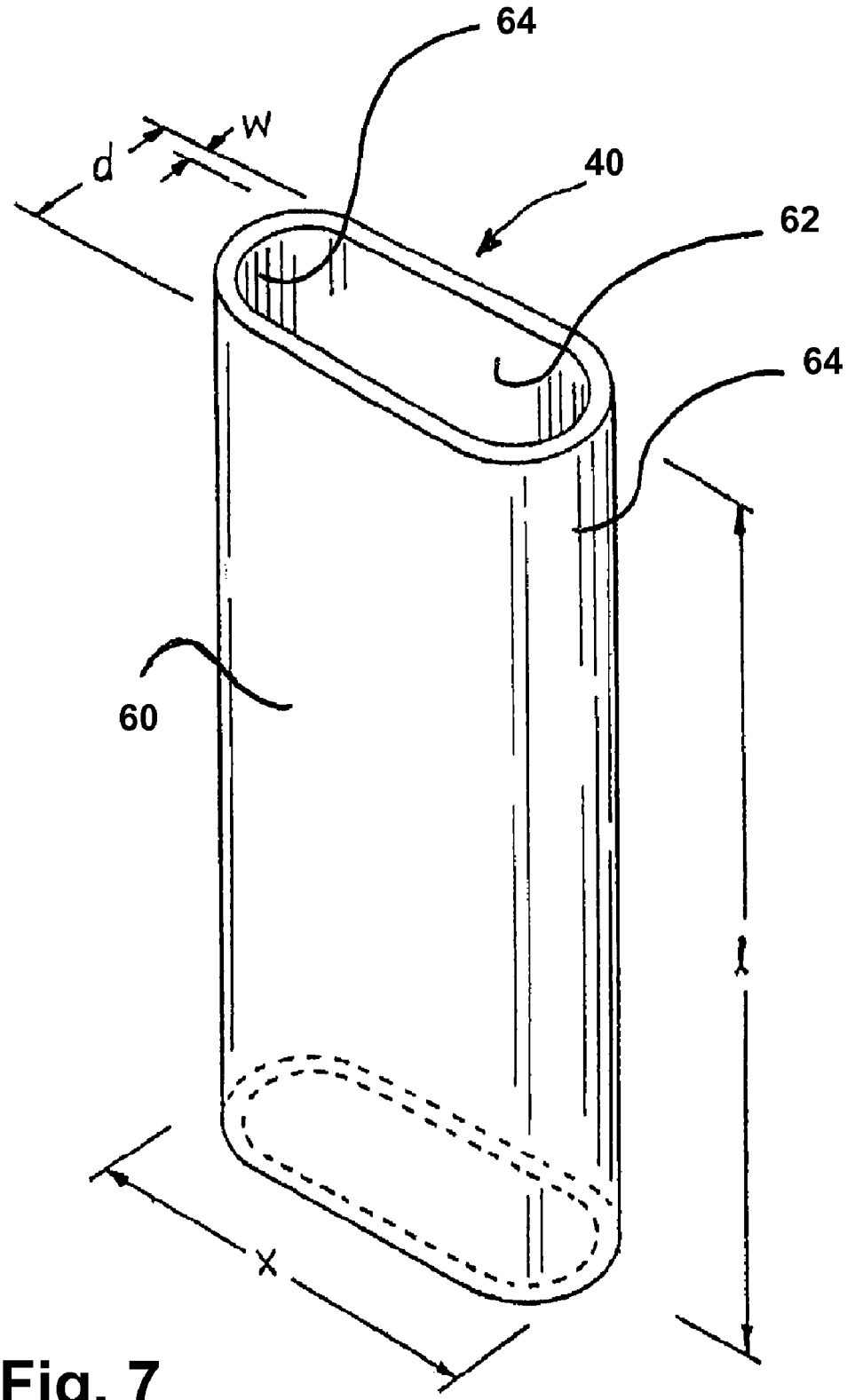
FIG. 7 shows a perspective view of a first cooling duct constructed in accordance with a first embodiment of the present invention.
Figure 8:
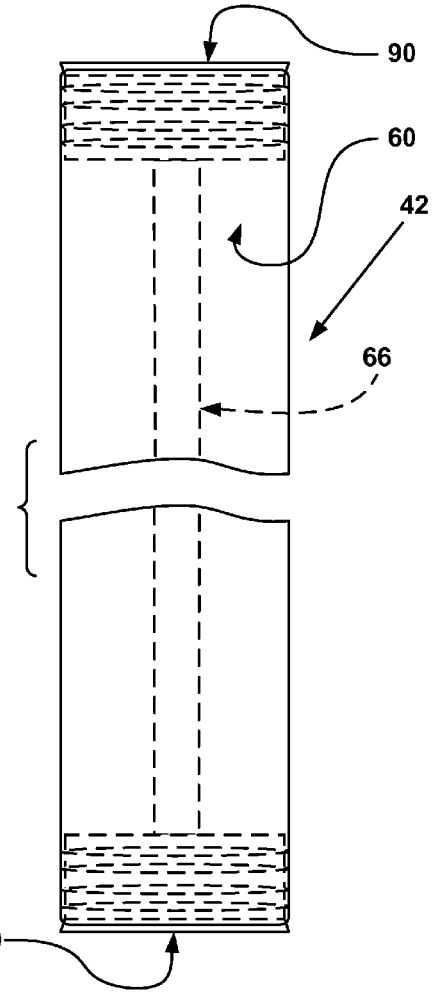
FIG. 8 shows an elevational view of a second cooling duct embodied in accordance with a second embodiment of the present invention.
Figure 9:
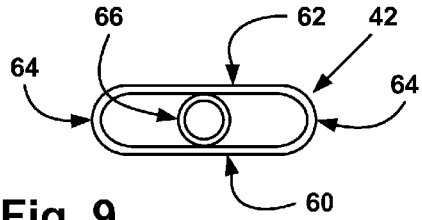
FIG. 9 shows an end view of the second cooling duct.

In FIGS. 2 and 3, the cooling ducts 40 or 42 are shown generically for purposes of ease of illustration. The structure of the cooling ducts 40 is shown in FIG. 7, while the structure of the cooling ducts 42 is shown in FIGS. 8 and 9. Both cooling ducts 40, 42 are described in more detail in the paragraphs that follow. The number of cooling ducts shown in FIGS. 2 and 3 should not be construed as limiting the scope of the present invention. A greater or lesser number of cooling ducts 40, 42 may be utilized.

Figure 5:
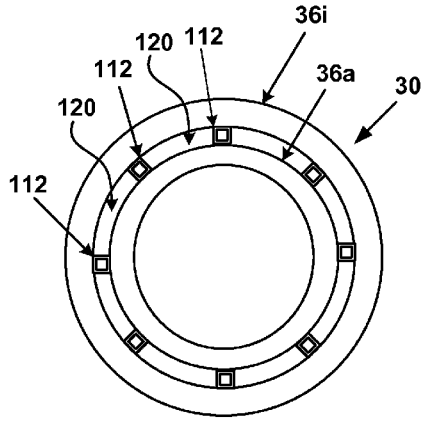
FIG. 5 shows an end view of the coaxial pairs of the disc windings.

Referring now to FIGS. 4 and 5, each disc winding 36 comprises a plurality of concentric layers of a conductor 46. The conductor 46 is composed of a metal such as copper or aluminum and may be in the form of a wire with an elliptical or rectangular cross-section. Alternately, and as shown, the conductor 46 may be in the form of a foil, wherein the conductor 46 is thin and rectangular, with a width as wide as the disc winding 36 it forms. In the embodiments shown and described, it has been found particularly useful to use foil conductors, more specifically foil conductors having a width to thickness ratio of greater than 20:1, more particularly from about 250:1 to about 25:1, more particularly from about 200:1 to about 50:1, still more particularly about 150:1. In one particular embodiment, the foil conductor is between about 0.008 to about 0.02 inches thick and between about 1 and 2 inches wide, more particularly about 0.01 inches thick and about 1.5 inches wide. In each disc winding 36, the turns of the conductor 46 are wound in a radial direction, one on top of the other, i.e., one turn per layer. A layer of insulating material is disposed between each layer or turn of the conductor 46. In this manner, there are alternating layers of the conductor 46 and the insulating material. The insulating material may be comprised of a polyimide film, such as is sold under the trademark Nomex®; a polyamide film, such as is sold under the trademark Kapton®, or a polyester film, such as is sold under the trademark Mylar®.

Figure 6:
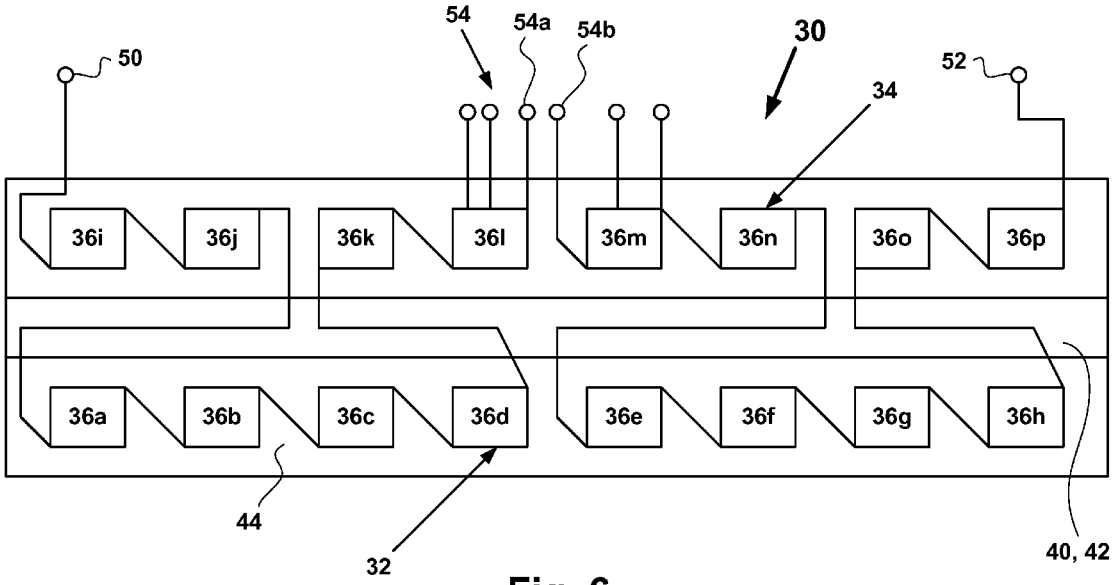
FIG. 6 shows a wiring schematic of the transformer.

The disc windings 36 may be connected together in the manner shown in FIG. 6. As shown, the first conductor layer 32 comprises disc windings **36*a*-36*h* and the second conductor layer 34 comprises disc windings 36*i*-36*p*. In the first conductor layer 32, the disc windings 36*a*-36*d* are serially connected together and the disc windings 36*e*-36*h* are serially connected together. The disc winding 36*d* is not connected to the adjacent disc winding 36*e*. In this manner, the first conductor layer 32 has two groups of serially-connected disc windings 36, wherein the two groups are not directly connected together. In the second conductor layer 34, there are four groups of disc windings 36 that are not connected together, wherein each group consists of a pair of connected-together disc windings 36. The four pairs are: 36*i* and 36*j*, 36*k* and 36*l*, 36*m* and 36*n* and 36*o* and 36*p*. Main taps 50, 52 are connected to the disc windings 36*i*, 36*p*, respectively of the second conductor layer 34. Nominal taps 54 are connected to different disc windings 36, respectively. Connecting together different pairs of the nominal taps 54 changes the turns ratio of the transformer 10. For example, connecting together the nominal taps 54*a* and 54*b* serially connects together all of the disc windings 36 in both the first and second conductor layers 32, 34. The main taps 50, 52 are located toward ends of the high voltage coil 30, respectively, while the nominal taps are located toward the center of the high voltage coil 30. The main taps 50, 52 and nominal taps are located in the dome 82 of the high voltage coil 30**.

Referring now to FIG. 7, there is shown one of the cooling ducts 40, which is constructed in accordance with a first embodiment of the present invention. Each cooling duct 40 has a generally elliptical cross-section, with open ends and spaced-apart generally planar front and rear walls 60, 62 joined together by a pair of spaced-apart curved side walls 64. It has been found particularly useful to provide each cooling duct 40 with a linear dimension, x, that is about three times the width, d, of the cooling duct 52. Each cooling duct 40 is comprised of a fiber reinforced plastic in which fibers, such as fiberglass fibers, are impregnated with a thermoset resin, such as a polyester resin, a vinyl ester resin, or an epoxy resin. In one embodiment, the cooling ducts 40 are each formed using a pultrusion process, wherein the fibers are drawn through one or more baths of the thermoset resin and are then pulled through a heated die where the thermoset resin is cured. The fibers may be aligned as either unidirectional roving or a multi-directional mat. In this embodiment, the thermoset resin may be a polyester resin. In another embodiment, the cooling ducts 40 are each formed using a tape comprised of fiber glass impregnated with an F-class epoxy resin (suitable for use above 150° C.) that is about 70% cured. The tape is wound around a mold and then fully cured under the application of heat.

Referring now to FIGS. 8 and 9, there is shown one of the cooling ducts 42, which is constructed in accordance with a second embodiment of the present invention. The cooling duct 42 may have the same construction as the cooling duct 40, except a support pipe 66 is secured between the front and rear walls 60, 62. More specifically, the cooling duct 42 may be constructed by securing the support pipe 66 inside the cooling duct 40. The support pipe 66 is comprised of the same material as the cooling duct 40 (i.e., fiber-reinforced plastic that is formed by pultrusion or tape wrapping) and is constructed to be rigid. The support pipe 66 is cylindrical in shape and has a hollow interior. The support pipe 66 is sufficiently shorter than the cooling duct 40 so that gaps are formed between ends of the support pipe 66 and ends of the cooling duct 40, respectively, when the support pipe 66 is secured between the front and rear walls 60, 62. A high strength adhesive, such as a two-part epoxy adhesive, may be used to secure the support pipe 66 between the front and rear walls 60, 62. The support pipes 66 help strengthen the cooling ducts 42 and prevents the cooling ducts 42 from collapsing or deforming when a vacuum is applied to the cooling ducts 42 during the resin casting process.

The cooling ducts 40, 42 are installed after the first conductor layer 32 is formed. Depending on the manufacturing method utilized, the cooling ducts 40, 42 may be installed before or after the second conductor layer 34 is wound.

Figure 11:
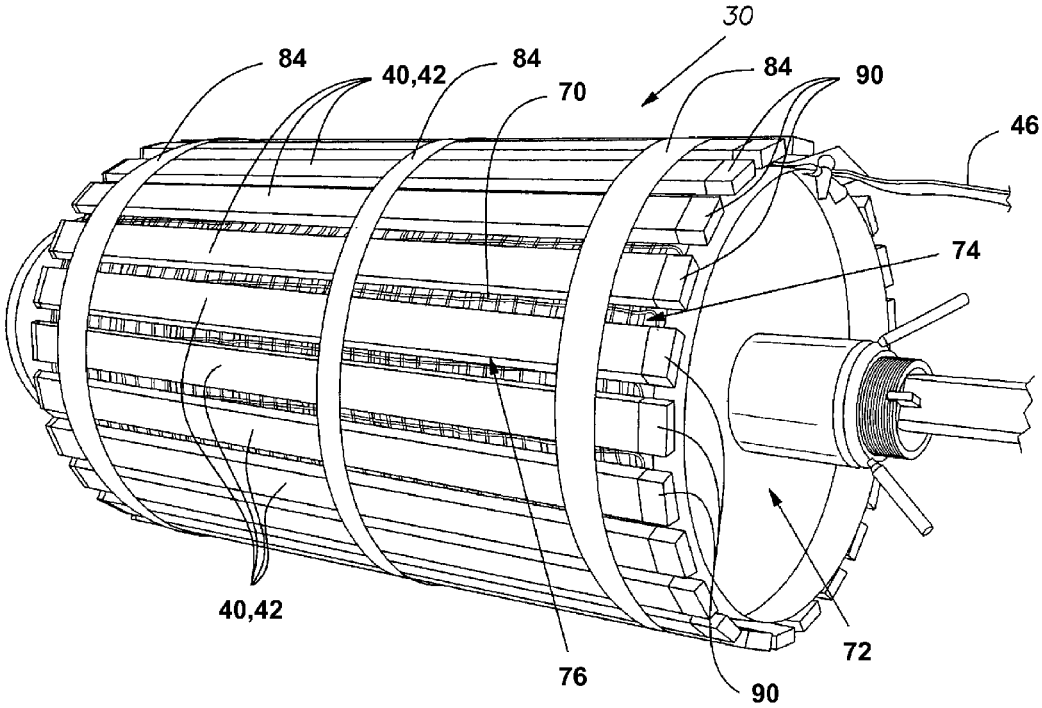
FIG. 11 shows a side perspective view of the coil of the transformer being formed on a winding mandrel in a first manufacturing method of the present invention.
Figure 12:
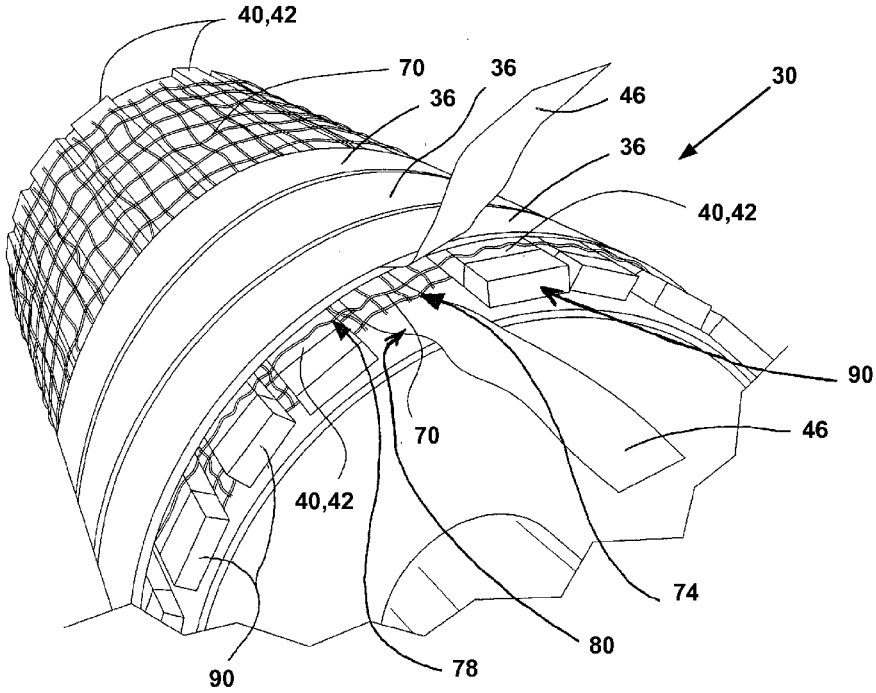
FIG. 12 shows an end perspective view of a portion of the coil being formed on the mandrel in the first manufacturing method.

Referring now to FIGS. 11 and 12, there is shown one of the high voltage coils 30 being manufactured in accordance with a first manufacturing method of the present invention. Initially, a first insulating layer (not shown) is formed over a winding mandrel 72 of a winding machine. The first insulating layer may be formed on an inner mold mounted to the mandrel 72 or may be formed directly on the mandrel 72, depending on the mold that is used during the resin casting process. The winding mandrel 72 may be rotated by an electric motor. Rotation of the mandrel 72 is used to wind the conductor 46 and insulating material over the mandrel 72 to form layers of the high voltage coil 30, as described below. The first insulating layer comprises a sheet or web of screen material 70, which is comprised of glass fibers woven into a grid with rectangular openings. More specifically, the screen material 70 has spaced-apart longitudinally arranged glass fibers that adjoin spaced-apart laterally arranged glass fibers at intersections that form the corners of the rectangular openings. The glass fibers may be impregnated with an insulating resin, such as an epoxy. A mound or button of insulating material may be joined to each intersection and protrudes above the web and may also protrude below the web. The buttons have a rounded shape and may be formed by building up the insulating resin at the intersections. The screen material 70 may have the construction and arrangement of the screen material disclosed in U.S. patent application Ser. No. 10/858,039 (Publication No. 2005/0275496), which is hereby incorporated by reference. The web of screen material 70 is wound around the winding mandrel 72 to form a cylinder and opposing longitudinal edges of the web are held together, at least temporarily with a glass fiber tape.

The first conductor layer 32 is formed (wound) over the first insulating layer from two or more lengths of the conductor 46. The glass fiber tape holding the first insulating layer together may be removed as the first conductor layer 32 is being formed, or the glass fiber tape may be left in place. In forming the disc windings 36, the conductor 46 can be continuously wound or may be provided with "drop-downs". If the conductor 46 is continuously wound, the conductor 46 is wound in alternating directions, i.e., inside to outside and then outside to inside, etc. If the conductor 46 is provided with drop-downs, the conductor 46 is wound in one direction, i.e., inside to outside. A drop-down is a bend that is formed at the completion of a disc winding 36 to bring the conductor 46 from the outside back to the inside to begin a subsequent disc winding 36.

After the first conductor layer 32 has been formed, a second insulating layer 74 comprised of a sheet or web of the screen material 70 is formed over the first conductor layer 32. Opposing longitudinal edges of the web are held together, at least temporarily with a glass fiber tape. Next, a layer 76 of cooling ducts 40, 42 is disposed over the second insulating layer 74, as will be described more fully below. A third insulating layer 78 comprised of a sheet or web of the screen material 70 is then formed over the layer of cooling ducts 40, 42.

The second conductor layer 34 is formed over the installed layer 76 of the cooling ducts 40, 42 from a plurality of lengths of the conductor 46. After the second conductor layer 34 has been formed, a fourth insulating layer (not shown) comprised of a sheet or web of the screen material 70 is formed over the second conductor layer 34. The partially-formed coil 30 is then ready to be impregnated with the insulating resin 45, which is described in more detail below.

When the disc windings 36 are formed between the first and second insulating layers comprised of the grid material with buttons, as described above, the disc windings 36 are held between the buttons so as to form insulation gaps between the disc windings 36 and the grids of the screen material disposed on opposing sides of the disc windings 36. Such insulation gaps are also formed on the opposing sides of the cooling ducts 40, 42. Such insulation gaps are filled by the insulating resin 45 during the encapsulation of the coils with insulating resin 64.

Returning now to the formation of layer 76 of the cooling ducts 40, 42, each cooling duct 40, 42 is wrapped with a layer of glass tissue along its entire length before installation. In addition, before installation, each cooling duct 40, 42 is wrapped at each end with tape comprised of a compressible material, such as a closed cell silicone foam or silicone rubber. The compressible tape is wrapped at each end of the cooling duct 40, 42 so as to extend about 3 centimeters down from the end. Each cooling duct 40, 42 can further be wrapped at each end with the screen material 70 used to form the insulating layers. This further wrapping extends about 10 cm down from each end. After being wrapped as described above, the cooling ducts 40, 42 are disposed around the circumference of the partially formed coil 30, over the second insulating layer 74. The cooling ducts 40, 42 are substantially evenly spaced apart, except for an enlarged spacing or gap 80, wherein the dome 82 is formed during the encapsulation process. The cooling ducts 40, 42 are initially held in place by a plurality of bands 84 of a glass fiber tape that are disposed around the layer 76 of cooling ducts 40, 42. As shown, the cooling ducts 40, 42 extend longitudinally between first and second ends of the partially-formed coil.

Figure 10:
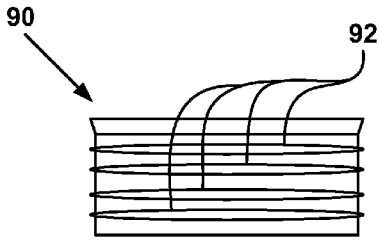
FIG. 10 shows an elevational view of a plug adapted for insertion into an end of the first cooling duct or the second cooling duct.

In forming the layer 76, either the cooling ducts 40 or the cooling ducts 42 may be used. If the cooling ducts 42 are used, the support pipes 66 provide the cooling ducts 42 with support during the resin casting process. Plugs 90 are simply inserted into the ends of each cooling duct 42, respectively, and then the partially-formed coil 30 is encapsulated in the insulating resin 45, as will be described more fully below. The plugs 90 keep the insulating resin 45 from flowing into the cooling ducts 42 during the resin casting process. Each plug 90 is composed of a resilient material, such as silicone rubber, and is dimensioned to frictionally fit within the gap formed between the end of the support pipe 66 and the end of the cooling duct 42. More specifically, as shown in FIG. 10, each plug 90 has a body that is tapered inwardly (i.e., downwardly) and has ribs 92 disposed around the periphery of the body to ensure a positive seal with inner surfaces of the cooling duct 42. After the resin casting process, the plugs 90 are removed from the cooling ducts 42.

Figure 13:
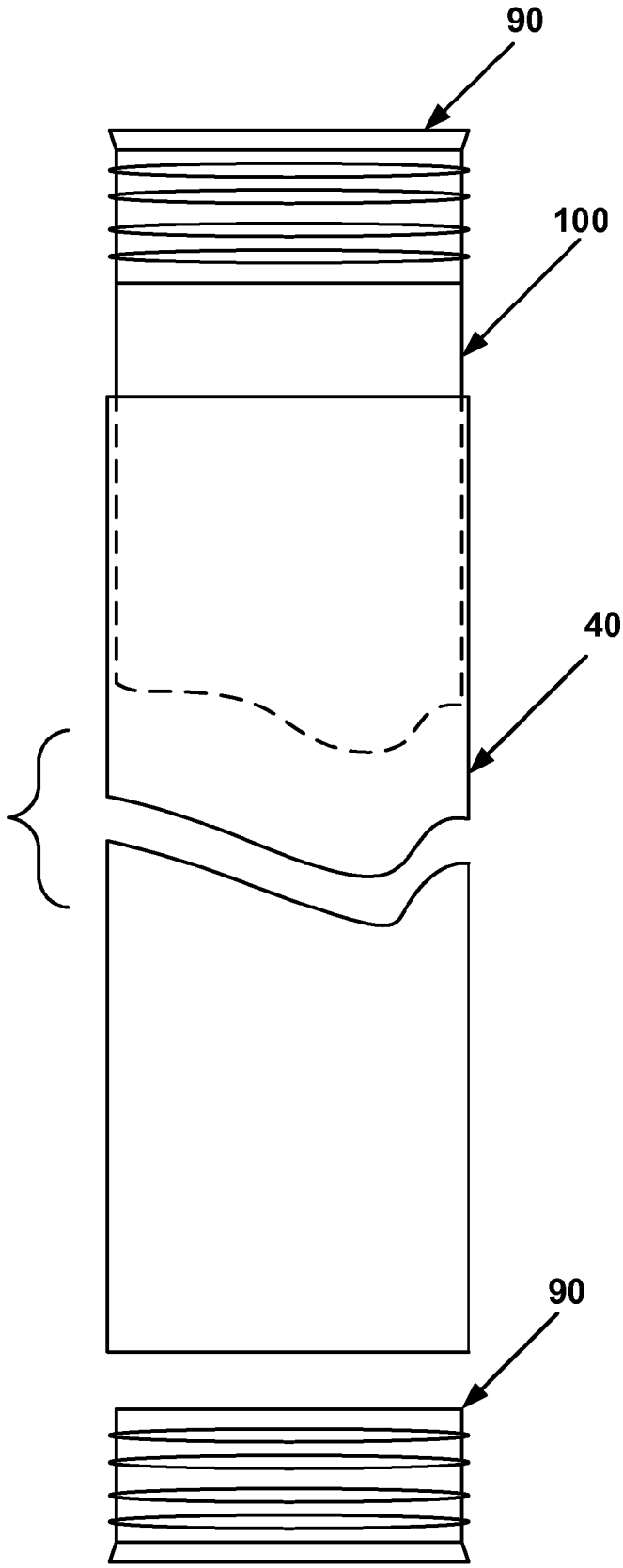
FIG. 13 shows a schematic view of an insert partially inserted inside the first cooling duct.

If the cooling ducts 40 are used, inserts 100 (shown in FIG. 13) are used with them. The inserts 100 are formed from a high temperature plastic, such as polyphenylene sulfide, polyamideimide, polyimide, polyaramide, polyphthalamide or polyether ether ketone (PEEK). Each insert 100 has a cross-section that is elliptical and is sized so that the insert 100 can be facilely inserted into one of the cooling ducts 40. The inserts 100 may be solid or hollow. If the inserts 100 are hollow, they have sufficient wall thickness so as to not be deformable. Each insert 100 is sufficiently shorter than the cooling duct 40 so that gaps are formed between ends of the insert 100 and ends of the cooling duct 40, respectively, when the insert 100 is disposed inside the cooling duct 40. The gaps are sized to receive the plugs 90. For each insert 100, one of the plugs 90 may be secured to an end of the insert 100 by a mechanical fastener (such as a screw or a bolt) and/or a high strength adhesive. Alternately, the inserts 100 may be separate from the plugs 90.

The inserts 100 are inserted inside the cooling ducts 40, respectively, either before or after the cooling ducts 40 are installed in the partially formed coil 30. After the inserts 100 are inserted into the cooling ducts 40, plugs 90 are inserted into the ends of the cooling ducts 40. If plugs 90 are attached to ends of the inserts 100, as described above, the attached plugs 90 are inserted into first ends of the cooling ducts 40 at the time the inserts 100 are inserted. In this manner, plugs 90 only need to be inserted into second ends of the cooling ducts 40. If the plugs 90 are not attached to the inserts 100, plugs 90 are inserted into both first and second ends of the cooling ducts 40. During the resin casting process, the inserts 100 internally support the cooling ducts 40 and prevent the cooling ducts 40 from collapsing or deforming when a vacuum is applied to the cooling ducts 40. After the resin casting process, the plugs 90 and the inserts 100 are removed from the cooling ducts 40.

Figure 14:
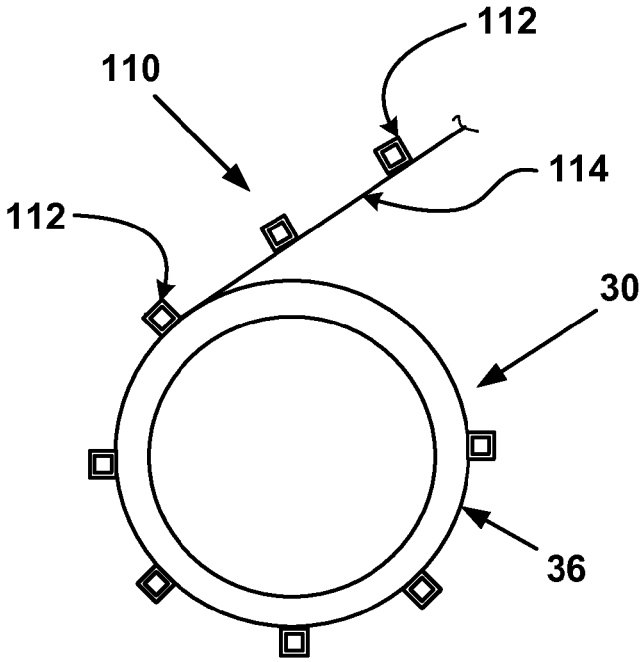
FIG. 14 shows an end view of the coil being formed in a second manufacturing method of the present invention, wherein a spacer tape is wrapped over a first conductor layer.
Figure 15:
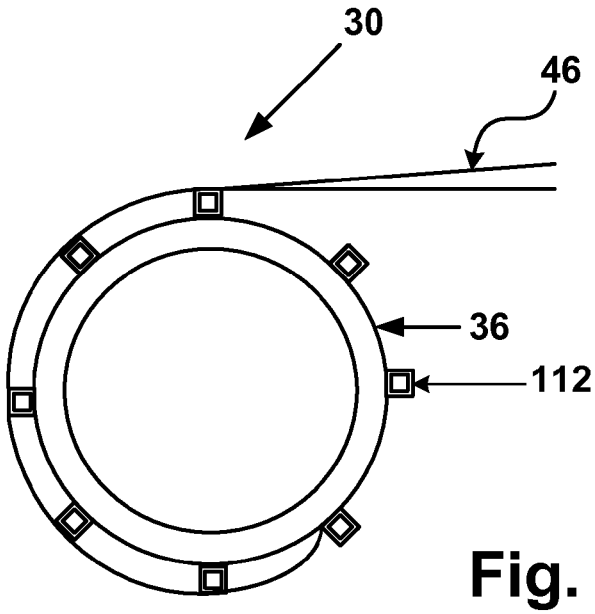
FIG. 15 shows an end view of the coil being formed in the second manufacturing method, wherein a second conductor layer is wrapped over spacers of the spacer tape.

Referring now to FIGS. 14 & 15, there is shown one of the high voltage coils 30 being manufactured in accordance with a second manufacturing method of the present invention. In the second manufacturing method, the first insulating layer is formed in the same manner as in the first manufacturing method described above. Next, the coaxial pairs 37 of windings 36 are formed, wherein each coaxial pair 37 comprises an inner disc winding 36 of the first conductor layer 32 coaxially disposed inside an outer disc winding 36 of the second conductor layer 34. The coaxial pairs 37 of windings 36 may be formed serially, with one coaxial pair 37 being completely formed and then an adjacent coaxial pair 37 being completely formed and then another and so on. Alternately, the entire first conductor layer 32 may be formed first and then the second conductor layer 34 may be formed over the same.

In each coaxial pair 37 of disc windings 36, an inner disc winding 36 in the first conductor layer 32 is formed first. Next, the disc winding 36 is wrapped with one turn of a spacer tape 110 that comprises a plurality of spaced-apart spacers 112 secured to a piece of insulating tape 114 comprised of an insulating material, such as polyimide, polyamide, or polyester. Each spacer 112 has a rectangular cross-section and may be composed of a fiber reinforced plastic in which fibers, such as fiberglass fibers, are impregnated with a thermoset resin, such as a polyester resin, a vinyl ester resin, or an epoxy resin. The spacers 112 are secured to the tape 114 by an adhesive and extend longitudinally along the width of the tape 114. In the embodiment where the conductor 46 forming the disc windings 36 is comprised of foil, the lengths of the spacers 112 and the width of the tape 114 are about the same as the width of the conductor 46. The spacers 112 are spaced apart by a distance that is slightly greater than the long width (dimension x) of the cooling ducts 40, 42. In addition, the dimension of the spacers 112 in a direction perpendicular to the tape 114 is slightly greater than the small width (dimension d) of the cooling ducts 40, 42. In this manner, the spacers 112 form spaces that can accommodate the cooling ducts 40, 42, as will be described more fully below. The spacer tape 110 is wrapped onto the disc winding 36 to form a single turn such that the tape 114 adjoins the disc winding 36 and the spacers 112 extend radially outward like spokes. Ends of each piece of spacer tape 110 may be fastened together (such as by adhesive tape) to form a loop that is disposed radially outward from the disc winding 36. The loop may be secured to the radially inward disc winding 36. In lieu of a separate piece of the spacer tape 110 being used to form the single turn, the spacer tape 110 may be part of a long length of the insulating tape 114 that is used to form an outer disc winding 36 over the spacers 112. In this embodiment, the spacers 112 are secured to only a portion of the long length of the insulating tape 114 and only one end of the tape 114 is secured to the radially inward disc winding 36. After the portion of the tape 114 with the spacers 112 secured thereto is disposed around the circumference of the radially inward disc winding 36, the tape 114 continues to be wound over the spacers 112 (together with the conductor 46) to form the radially outer disc winding 36. During this winding, the tension of the winding machine keeps the insulating tape 114 (and the conductor 46) in position.

After the inner disc winding 36 in the first conductor layer 32 has been wrapped with a piece of spacer tape 110, an outer disc winding 36 in the second conductor layer 34 is formed over the loop of the spacer tape 110 so as to be supported on the spacers 112 and spaced from the inner disc winding 36.

An initial layer of the insulating material directly contacts the spacers 112. Thereafter, alternating layers of the conductor 46 and the insulating material are wound over the loop of the spacer tape 110 to form the outer disc winding 36. When the outer disc winding 36 is complete, the inner and outer disc windings 36 are separated by a series of circumferentially arranged spaces 120 separated by the spacers 112, as shown in FIG. 5.

Figure 16:
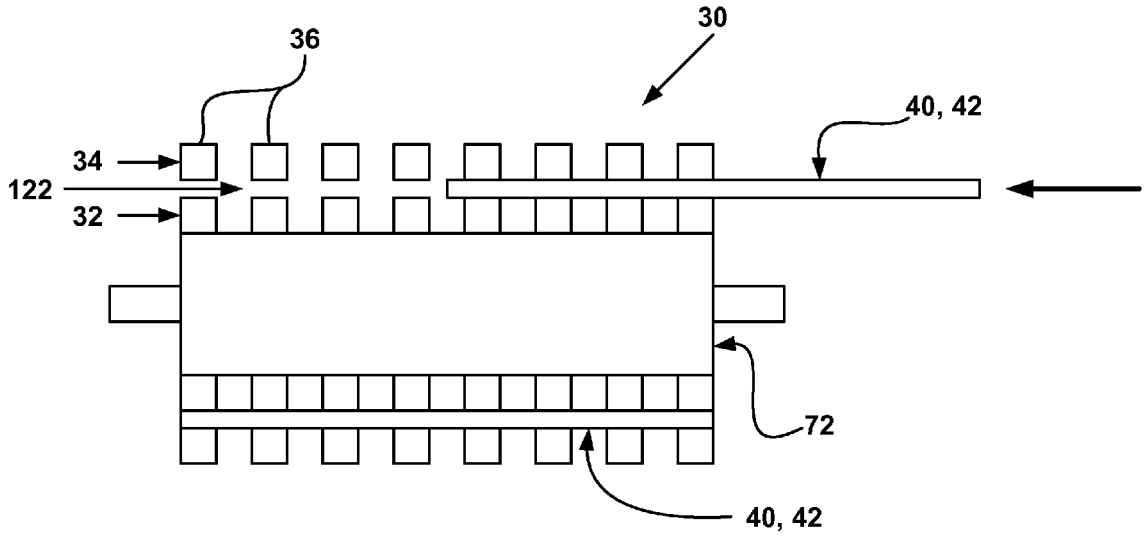
FIG. 16 shows a schematic view of a cooling duct being inserted into the coil during the second manufacturing method.

The spacer tape 110 is wound on each disc winding 36 of the first conductor layer 32 in the same manner so that the spacers 112 and spaces 120 in the coaxial pairs of disc windings 36 are aligned along the axial length of the high voltage coil 30. In this manner, when the formation of the coaxial pairs of disc windings 36 is complete, the aligned spaces 120 form a series of passages 122 (shown in FIG. 16) extending axially through the partially formed high voltage coil 30.

After the coaxial pairs of disc windings 36 have been formed, an outer insulating layer (not shown) comprised of a sheet or web of the screen material is formed over the second conductor layer 34. The cooling ducts 40, 42 are then inserted into the passages 122, respectively, so that ends of the cooling ducts 40, 42 are substantially aligned with ends of the partially formed high voltage coil 30, respectively. As in the first manufacturing method, before each cooling duct 40, 42 is inserted, it is wrapped with a layer of glass tissue along its entire length and then each of its ends is wrapped with tape comprised of a compressible material, such as a closed cell silicone foam or silicone rubber. Also as in the first manufacturing method, each cooling duct 40, 42 can further be wrapped at each end with the screen material used to form the insulating layers.

In the second manufacturing method, as in the first manufacturing method, either the cooling ducts 40 or the cooling ducts 42 may be used. The plugs 90 and inserts 100 are used in the same manner as described above for the first manufacturing method.

Once the high voltage coil 30 has been fully wound and the cooling ducts 40, 42 installed, the high voltage coil 30 is removed from the winding mandrel 72 and then encapsulated in the insulating resin 45 during the resin casting process. The coil 30 is first enclosed in a mold that includes generally cylindrical inner and outer molds. The inner mold is inserted into the open center of the coil 30 and the outer mold is disposed around the coil 30. If the inner mold was mounted to the winding mandrel 72 and the coil 30 then wound over the inner mold, only the outer mold has to be disposed around the outside of coil 30. The mold may be a vertical mold, i.e., the mold holds the coil 30 with the axis of the coil 30 extending vertically, or the mold may be a horizontal mold, i.e., the mold holds the coil 30 with the axis of the coil 30 extending horizontally. An example of a horizontal mold that may be utilized is disclosed in U.S. Pat. No. 6,223,421, which is hereby incorporated by reference. An example of a vertical mold that may be used is disclosed in U.S. Pat. No. 7,023,312, which is also hereby incorporated by reference. It should be appreciated that the support pipes 66 in the cooling ducts 42 and the temporary presence of the inserts 100 in the cooling ducts 40 provide sufficient support to the cooling ducts 40, 42, respectively, to permit the coil 30 to be encapsulated with the insulating resin 45 in a horizontal mold, which was previously not possible.

The coil 30 and the mold are pre-heated in an oven to remove moisture from the insulating layers and the conductor layers. The coil 30 is then placed in a vacuum chamber. The vacuum chamber is evacuated to remove any remaining moisture and gases in the coil 30 and to eliminate any voids between adjacent turns in the disc windings 36. The insulating resin 45, which is flowable, is poured between the inner and outer molds to encapsulate the coil 30. The vacuum is held for a predetermined time interval to allow the insulating resin 45 to impregnate the screen material of the insulating layers. The vacuum is then released. Pressure may then be applied to the resin-coated coil 30 to force the insulating resin 45 to impregnate any remaining voids in the insulating layers. The coil 30 is then removed from the vacuum chamber and placed in an oven to cure the insulating resin 45 to a solid.

The curing process in the oven is conventional and well known in the art. For example, the cure cycle may comprise a (1) gel portion for about 5 hours at about 85 degrees C., (2) a ramp up portion for about 2 hours where the temperature increases from about 85 degrees C. to about 140 degrees C., (3) a cure portion for about 6 hours at about 140 degrees C., and (4) a ramp down portion for about 4 hours to about 80 degrees C. Following curing, the inner and outer molds are removed. The plugs 90 may be easily removed with pliers or other gripping devices without damaging the surrounding insulating resin 45. If inserts 100 are used, each insert 100 may be removed from its respective cooling duct 40 by inserting a bar or rod (not shown) through an end of the cooling duct 40 and pushing the insert 100 out of the cooling duct 40 through the other end The insulating resin 45 may be an epoxy resin or a polyester resin. An epoxy resin has been found particularly suitable for use as the insulating resin 45. The epoxy resin may be filled or unfilled. An example of an epoxy resin that may be used for the insulating resin 45 is disclosed in U.S. Pat. No. 6,852,415, which is hereby incorporated by reference. Another example of an epoxy resin that may be used for the insulating resin 45 is Rutapox VE-4883, which is commercially available from Bakelite AG of Iserlohn of Germany.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A method of manufacturing a transformer comprising:

forming a disc-wound coil comprising:

providing a plurality of pre-formed cooling ducts;

forming a first conductor layer comprising a plurality of disc windings arranged in an axial direction of the disc-wound coil, each of the disc windings comprising a conductor wound into a plurality of concentric turns;

forming a spacer layer over the first conductor layer, the spacer layer comprising a plurality of spacers;

forming a second conductor layer over the spacer layer, the second conductor layer comprising a plurality of disc windings arranged in an axial direction of the disc-wound coil, each of the disc windings comprising a conductor wound into a plurality of concentric turns, wherein the spacer layer is formed such that when the second conductor layer is formed, a plurality of axially-extending passages are formed between the first and second conductor layers; and sliding the pre-formed cooling ducts into the axially-extending passages so as to be disposed between the first and second conductor layers.

2. The method of claim 1, wherein the number of disc windings in the first conductor layer is the same as in the second conductor layer.

3. The method of claim 2, wherein the disc windings of the first conductor layer are coaxially disposed inside the disc windings of the second conductor layer, respectively, so as to form a plurality of coaxial pairs of disc windings.

4. The method of claim 3, wherein the step of forming the spacer layer comprises disposing a plurality of spacers around a circumference of each disc winding in the first conductor layer.

5. The method of claim 4, wherein the step of disposing a plurality of spacers around a circumference of each disc winding comprises providing a piece of tape having a plurality of the spacers secured thereto in a spaced-apart manner and winding the piece of tape around the circumference of the disc winding.

6. The method of claim 5, wherein the tape is compressible and the spacers are secured to the tape by an adhesive.

7. The method of claim 1, wherein each of the pre-formed cooling ducts has an enclosed periphery that defines a through-passage that extends between ends of the cooling duct.

8. The method of claim 7, further comprising:

providing a plurality of inserts sized to fit inside the pre-formed cooling ducts; and inserting the inserts into the cooling ducts.

9. The method of claim 8, wherein the inserts are comprised of a different material than the pre-formed cooling ducts.

10. The method of claim 8, further comprising:

providing a plurality of plugs; and inserting the plugs into the ends of each pre-formed cooling duct, respectively, after one of the inserts has been inserted into the pre-formed cooling duct.

11. The method of claim 10, wherein the plugs are comprised of silicone rubber.

12. The method of claim 10, further comprising after the plugs have been inserted into the pre-formed cooling ducts, encapsulating the first and second conductor layers and the pre-formed cooling ducts in an insulating resin.

13. The method of claim 12, further comprising:

after encapsulating the first and second conductor layers and the pre-formed cooling ducts in the insulating resin, removing the plugs from the pre-formed cooling ducts; and after removing the plugs, removing the inserts from the pre-formed cooling ducts.

14. The method of claim 1, wherein the pre-formed cooling ducts and the first and second conductor layers have substantially the same lengths.

15. The method of claim 14, wherein each of the pre-formed cooling ducts has an enclosed periphery comprising a pair of parallel walls, the enclosed periphery defining a through-passage that extends between ends of the cooling duct.

16. The method of claim 15, wherein each of the pre-formed cooling ducts further comprises a support tube secured between the parallel walls.

17. The method of claim 16, wherein in each pre-formed cooling duct, the support tube is shorter than the parallel walls and is positioned such that at each end of the pre-formed cooling duct a gap is formed between an end of the support tube and ends of the parallel walls.

18. The method of claim 1, further comprising wrapping each end of each pre-formed cooling duct with a compressible tape before sliding the pre-formed cooling ducts into the axially-extending passages.

19. A transformer comprising:

a disc-wound coil comprising:

a first conductor layer comprising a plurality of disc windings arranged in an axial direction of the disc-wound coil, each of the disc windings comprising a conductor wound into a plurality of concentric turns;

a second conductor layer disposed over the first conductor layer, the second conductor layer comprising a plurality of disc windings arranged in an axial direction of the disc-wound coil, each of the disc windings comprising a conductor wound into a plurality of concentric turns;

a spacer layer disposed between the first and second conductor layers, the spacer layer comprising a plurality of spacers arranged so as to form a plurality of axially-extending passages between the first and second conductor layers; and a plurality of cooling ducts disposed inside the axially-extending passages, respectively, thereby being positioned between the first and second conductor layers.

20. The transformer of claim 19, wherein each of the cooling ducts has an enclosed periphery comprising a pair of parallel walls, the enclosed periphery defining a through-passage that extends between ends of the cooling duct, and wherein each of the cooling ducts further comprises a support tube secured between the parallel walls.

* * * * *